US005504558A

United States Patent [19]

Ikezue

[11] Patent Number: 5,504,558

[45] Date of Patent: Apr. 2, 1996

[54] ELECTROPHOTOGRAPHIC PHOTOSENSITIVE MEMBER, AND ELECTROPHOTOGRAPHIC APPARATUS AND DEVICE UNIT EMPLOYING THE SAME

[75] Inventor: Tatsuya Ikezue, Yokohama, Japan

[73] Assignee: Canon Kabushiki Kaisha, Tokyo, Japan

[21] Appl. No.: 81,149

[22] Filed: Jun. 25, 1993

[30] Foreign Application Priority Data

Jun. 29, 1992 [JP] Japan ..... 4-192749

[51] Int. Cl.[6] ..... G03G 15/00

[52] U.S. Cl. ..... 355/211; 428/421; 430/56

[58] Field of Search ..... 355/210, 211, 355/212; 430/56, 58, 59, 69, 130, 137, 96; 428/537, 421

[56] References Cited

U.S. PATENT DOCUMENTS

| | | | |
|---|---|---|---|
| 4,232,101 | 11/1980 | Fukuda et al. | 430/56 |
| 4,663,259 | 5/1987 | Fujimara et al. | 430/58 |
| 5,112,713 | 5/1992 | Kato et al. | 430/96 |
| 5,178,983 | 1/1993 | Kato et al. | 430/96 |
| 5,215,844 | 6/1993 | Badesha et al. | 430/96 |
| 5,242,774 | 9/1993 | Odell et al. | 430/59 |
| 5,300,392 | 4/1994 | Odell et al. | 430/130 |
| 5,362,596 | 11/1994 | Matsumura et al. | 430/137 |

FOREIGN PATENT DOCUMENTS 0345737 12/1989 European Pat. Off. .

OTHER PUBLICATIONS

Patent Abstracts of Japan, vol. 12, No. 300 (p–745) (3147) Aug. 1988 for JP 63–073267.

Database WPI Week 8449, Derwent Publ., AN 84–303498 [49] re JP 59–188655.

Database WPI Week 9044, Derwent Publ., AN 90–330732 [44] re JP 2–236558.

*Primary Examiner*—A. T. Grimley
*Assistant Examiner*—Thu Dang
*Attorney, Agent, or Firm*—Fitzpatrick, Cella, Harper & Scinto

[57] ABSTRACT

The present invention provides an electrophotographic photosensitive member comprising a photosensitive layer formed on an electroconductive support, and a surface layer formed on the photosensitive layer, wherein said photosensitive layer contains a charge-generating substance, a charge-transporting substance, and a binder resin, and the surface layer contains a fluorine-atom-containing particulate resin, a charge-transporting substance, and a binder resin, wherein the binder resin in the surface layer and the binder resin in the photosensitive layer are composed of the same constitution components, the binder resin in the surface layer has a number-average molecular weight of from 50,000 to 160,000 and the binder resin in the photosensitive layer having a number-average molecular weight of from 10,000 to 50,000, and the number-average molecular weight of the binder resin in the surface layer is two or more times larger than that of the binder resin in the photosensitive layer.

18 Claims, 1 Drawing Sheet

ELECTROPHOTOGRAPHIC PHOTOSENSITIVE MEMBER, AND ELECTROPHOTOGRAPHIC APPARATUS AND DEVICE UNIT EMPLOYING THE SAME

BACKGROUND OF THE INVENTION

1. Field of the Invention

The present invention relates to an electrophotographic photosensitive member. More particularly, the present invention relates to an electrophotographic photosensitive member having a specified surface layer. The present invention also relates to an electrophotographic apparatus and a device unit employing the above electrophotographic photosensitive member.

2. Related Background Art

The electrophotographic photosensitive member is not only required to have sensitivity, and electric and optical properties suitable for the electrophotographic process in which the member is employed, but for the photosensitive member to be used repeatedly it is required to have sufficient resistance to the external electric and mechanical forces applied to the member in the cycle of corona charging, toner development, image transfer onto a recording medium, and surface cleaning. Specifically, the photosensitive member is required to be resistant to abrasion and scratching of the surface caused by sliding friction at the surface, and to the deterioration due to the action of ozone or nitrogen oxides. Additionally, the surface of the electrophotographic photosensitive member is required to have excellent cleaning performance in order to prevent undesired toner adhesion.

To satisfy such requirements, it is known to provide a surface protection layer which is mainly composed of a resin on the photosensitive layer. For example, Japanese Patent Application Laid-Open No. 62 -272282 discloses a protection layer containing a fluorine-containing resin particles and a charge-transporting substance to improve the mechanical durability and potential stability.

Generally, a film made from a resin of a lower molecular weight shows satisfactory adhesiveness to the other layer, but is less satisfactory in hardness and durability. On the contrary, a film made from a resin of a high molecular weight tends to have larger internal stress, resulting in crack formation in the film or brittleness of the film, particularly when a rather thick film like a photosensitive layer is formed.

With the increasing demands for image quality and durability, electrophotographic photosensitive members having more enhanced electrophotographic characteristics and much higher durability have been studied.

SUMMARY OF THE INVENTION

The present invention intends to provide an electrophotographic photosensitive member which has excellent electrophotographic characteristics and is capable of giving steadily excellent image quality even in repeated use.

The present invention also intends to provide an electrophotographic apparatus and a device unit employing the above electrophotographic photosensitive member.

The electrophotographic photosensitive member of the present invention comprises a photosensitive layer formed on an electroconductive support, and a surface layer formed on the photosensitive layer: the photosensitive layer containing a charge-generating substance, a charge-transporting substance, and a binder resin, and the surface layer containing a fluorine-atom-containing particulate resin, a charge-transporting substance, and a binder resin; the binder resin in the surface layer and the binder resin in the photosensitive layer are composed of the same constitution components, the binder resin in the surface layer having a number-average molecular weight of from 50,000 to 160,000 and the binder resin in the photosensitive layer having a number-average molecular weight of from 10,000 to 50,000; and the number-average molecular weight of the binder resin in the surface layer is two or more times larger than that of the binder resin in the photosensitive layer.

The present invention provides an electrophotographic apparatus and a device unit employing the above electrophotographic photosensitive member.

DESCRIPTION OF THE PREFERRED EMBODIMENT

Figure 1:
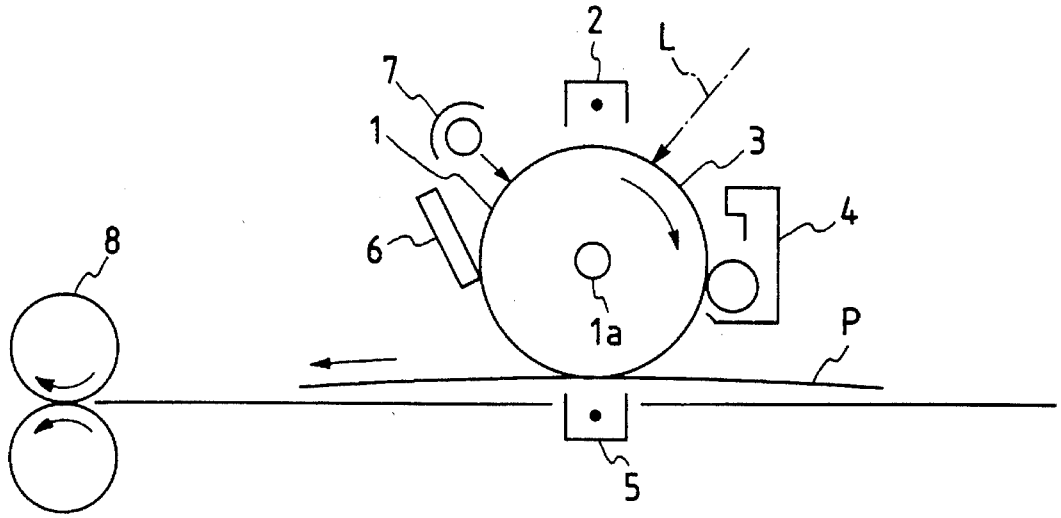
FIG. 1 shows schematically a constitution of an electrophotographic apparatus employing an electrophotographic photosensitive member of the present invention.

The present invention provides an electrophotographic photosensitive member, comprising a photosensitive layer formed on an electroconductive support, and a surface layer formed on the photosensitive layer: the photosensitive layer contains a charge-generating substance, a charge-transporting substance, and a binder resin, and the surface layer contains a fluorine-atom-containing particulate resin, a charge-transporting substance, and a binder resin; the second binder resin in the surface layer and the binder resin in the photosensitive layer is composed of the same constitution components, the binder resin in the surface layer has a number-average molecular weight of from 50,000 to 160,000 and the binder resin in the photosensitive layer has a number-average molecular weight of from 10,000 to 50,000; and the number-average molecular weight of the binder resin in the surface layer is two or more times larger than that of the first binder resin in the photosensitive layer.

In the present invention, the surface layer and the photosensitive layer are composed of the same kind of resin components. Accordingly, the bonding of the surface layer and the photosensitive layer is firm and the deformation of the bonded layers is less liable to occur owing to the higher affinity of the two layers, because of the less definite interface between them compared with the layers of different kinds of resins. Therefore a high molecular weight resin can be used for the surface layer, and it remarkably improves the durability, simultaneously decreasing carrier trap at the interface to give excellent electric characteristics.

On the other hand, the binder resin used in the surface layer in the present invention has a number-average molecular weight of two or more times larger than that of the resin used in the photosensitive layer, thereby a moderate interface is formed between the two layers. This interface prevents the migration of a charge-transporting substance or the like between the two layers, which gives extreme uniformity to the surface layer and the photosensitive layer, thereby resulting in more excellent image formation. If the ratio of the number-average molecular weight of the resin of the surface layer and that of the photosensitive layer is less than 2, the two layers become too compatible each other, to form the uniform surface state, causing uneven potential characteristics or rise of residual potential due to the migration of charge-transporting substance etc.

Further in the present invention, the electrophotographic photosensitive member exhibits high surface lubricity and excellent durability because the surface layer contains a fluorine-containing resin.

The photosensitive layer of the electrophotographic photosensitive member of the present invention containing a charge-generating substance, a charge-transporting substance, and a binder resin, is classified into two types: the single layer type and the lamination type. The single layer type contains both of a charge-generating substance and a charge-transporting substance in one layer. The lamination type comprises a charge-generating layer containing a charge-generating substance and a charge-transporting layer containing a charge-transporting substance. The lamination type is further subdivided into two types: one type comprising an electroconductive support, a charge-generating layer, and a charge-transporting layer in this order, and the other type containing an electroconductive support, a charge-transporting layer, and a charge-generating layer in this order. In the present invention, particularly preferred is the one having the charge-transporting layer laminated on the charge-generating layer.

In the lamination type photosensitive layer, the charge-generating layer contains a charge-generating substance selected from inorganic charge-generating substances such as selenium, selenium-tellurium, and amorphous silicon; cationic dyes such as pyrylium dyes, thiapyrylium dyes, azulenium dyes, thiacyanine dyes, and quinocyanine dyes; squarium salt dyes; phthalocyanine dyes; polycyclic quinone dyes such as anthanthrone dyes, dibenzopyrene-quinone dyes, and pyranthrone dyes; indigo dyes; quinacridone dyes; and azo dyes, or combination of two or more thereof. The charge-generating layer may be formed on an electroconductive support by a vapor deposition using a vacuum deposition apparatus, or by coating of a dispersion in which a charge-generating substance is dispersed in a binder resin with a solvent.

Such binder resin for the charge-generating layer includes a variety of insulating resins such as polyvinylbutyrals, polyarylates (e.g., polycondensate of bisphenol A with phthalic acid), polycarbonates, polyesters, polyvinyl acetates, acrylic resins, polyacrylamides, polyamides, cellulose resins, urethane resins, epoxy resins, polyvinyl alcohols, and so forth. The binder resin further includes organic photoconductive resins such as poly-N-vinylcarbazoles and polyvinylpyrenes. The binder resin is contained in the charge-generating layer at a content of not more than 90% by weight, more preferably not more than 50% by weight based on the total weight of the charge-generating layer. In a photosensitive layer in which the charge-generating layer is formed on the charge-transporting layer, however, the charge-generating layer should contain a binder resin, preferably in an amount of not less than 10% by weight, more preferably not less than 30% by weight based on the total weight of the charge-generating layer.

The charge-generating layer has a thickness of preferably from 0.001 to 6 μm, more preferably from 0.01 to 1 μm.

The charge-transporting layer may be formed by applying and drying a solution of a charge-transporting substance in a binder resin using a suitable solvent. The charge-transporting substance includes polycyclic aromatic compounds having the structure of biphenylene, anthracene, pyrene, phenanthrene, etc.; nitrogen-containing cyclic compounds such as indole, carbazole, oxadiazole and pyrazoline; hydrazone compounds, and styryl compounds.

The binder resin for the charge-transporting layer includes polyarylates, polysulfones, polyamides, acrylic resins, acrylonitrile resins, methacrylic resins, vinyl chloride resins, vinyl acetate resins, phenol resins, epoxy resins, polyesters, alkyd resins, polycarbonates, polyurethanes, styrene-butadiene copolymers, styrene-acrylic copolymers, styrene-acrylonitrile copolymers, styrene-maleic acid copolymers, and the like. In addition to the above insulating resins, organic photoconductive polymers such as polyvinylcarbazoles, polyvinylanthracenes, and polyvinylpyrenes can be used. Of the above resins, particularly preferred are acrylic resins, methacrylic resins, polycarbonates, and styrene-acrylic copolymers.

The charge-transporting layer contains the charge-transporting substance in an amount of preferably from 20 to 80 % by weight, more preferably from 30 to 70% by weight based on the total weight of the charge-transporting layer. The charge-transporting layer has a thickness of preferably from 10 to 35 μm, more preferably from 15 to 30 μm.

The single layer type photosensitive layer may be formed by applying a liquid dispersion or a solution of a charge-generating substance and a charge-transporting substance in the above-mentioned binder resin on an electroconductive support. The single layer type photosensitive layer has a thickness of preferably from 10 to 35 μm, more preferably from 15 to 30 μm.

In any type of the photosensitive layer in the present invention, the layer in contact with the surface layer contains a binder resin of number-average molecular weight of from 10,000 to 50,000, preferably from 15,000 to 40,000.

On the other hand, the surface layer of the electrophotographic photosensitive member of the present invention contains a fluorine-atom-containing particulate resin, a charge-transporting substance, and a binder resin. The particulate fluorine-atom-containing resin includes polytetrafluoroethylene, poly(chlorotrifluoroethylene), polyvinylidene fluoride, polydichlorodifluoroethylene, tetrafluoroethylene-perfluoroalkylvinyl ether copolymers, tetrafluoroethlene-hexafluoropropylene copolymers, tetrafluoroethylene-ethylene copolymers, tatrafluoroethylene-hexafluoropropylene-perfluoroalkylvinyl ether copolymers, and the like. Such a particulate resin may be used singly or in combination of two or more thereof. The number-average molecular weight thereof is preferably from 3,000 to 5,000,000, more preferably from 10,000 to 3,000,000. The average particle diameter is preferably from 0.01 to 10 μm, more preferably from 0.05 to 2.0 μm.

In the present invention, higher content of the particulate resin is preferable to improve the luburicity, but lower content is preferable to minimize light scattering by the resin particles. Therefore, specifically the content of the particulate resin is in the range of preferably from 30 to 70% by weight, more preferably from 40 to 65% by weight based on the total weight of the surface layer.

The charge-transporting substance contained in the surface layer includes the same ones for the photosensitive layer.

The binder resin contained in the surface layer includes the same binder resins for the photosensitive layer. In the present invention, the surface layer contains a resin composed of the same kind resin components as the resin of the photosensitive layer in contact with the surface layer. The binder resin of the surface layer has a number-average molecular weight of from 50,000 to 160,000, preferably from 60,000 to 100,000, which is two or more times as large as that of the binder resin of the photosensitive layer which is in contact with the surface layer. In consideration of the strain at the interface of the surface layer and the photosensitive layer, and the crack formation in the surface layer, the number-average molecular weight of the resin in the surface layer preferably does not exceed six or less times of that of the resin contained in the photosensitive layer adjacent to the surface layer. If the resin is a copolymer, the term "constitution components of the resin" means monomer units of the copolymer, and the copolymerization monomer ratio of the resin of the surface layer may be the same as or different from that of the resin in the photosensitive layer, although the same ratio is preferable.

The surface layer in the present invention may be prepared by dispersing or dissolving a fluorine-atom-containing particulate resin, a charge-transporting substance, and a binder resin in a suitable solvent, and applying and drying the resulting liquid on a photosensitive layer. The thickness of the surface layer is in the range of preferably from 0.05 to 10 μm, more preferably from 0.5 to 8 μm.

The electroconductive support in the present invention is made of a material such as aluminum, aluminum alloys, copper, zinc, stainless steel, vanadium, molybdenum, chromium, titanium, nickel, indium, gold, and platinum. The support may be made of a plastic material having a film of the aforementioned metal or alloy formed thereon by vapor deposition: the plastic material including polyethylene, polypropylene, polyvinyl chloride, polyethylene terephthalate, acrylic resins, etc. The support may be made a plastic, a metal or an alloy, coated with the particles of an electroconductive material such as carbon black and particulate silver using a suitable binder resin. Further the support may be made of a plastic sheet or a paper sheet impregnated with an electroconductive particulate material. The support may be in a shape of a drum, a sheet, or a belt, but is preferably of a shape suitable for the electrophotographic apparatus that employs the electrophotographic photosensitive member.

A subbing layer may be provided between the electroconductive support and the photosensitive layer. The subbing layer serves to control the carrier injection from the electroconductive support or to improve the bonding of the support and the photosensitive layer. The subbing layer is composed mainly of a resin, and may additionally contain a metal, an alloy, or an oxide or a salt thereof, or a surfactant. The resin for the subbing layer includes specifically polyesters, polyurethanes, polyarylates, polyethylenes, polystyrenes, polybutadienes, polycarbonates, polyamides, polypropylenes, polyimides, phenol resins, acrylic resins, silicone resins, epoxy resins, urea resins, allyl resins, alkyd resins, polyamide-imide reins, nylons,, polysulfones, polyallyl ethers, polyacetals, and butyral resins. The subbing layer has a thickness in the range of preferably from 0.05 to 7 μm, more preferably from 0.1 to 2 μm.

The coating method for the aforementioned layers includes dip coating, spray coating, beam coating, spinner coating, roller coating, Meyer bar coating, blade coating, and so forth.

The electrophotographic photosensitive member of the present invention is useful for a variety of electrophotographic apparatus such as electrophotographic copying machines, laser beam printers, LED printers, and liquid crystal shutter type printers, and for apparatus employing electrophotography technique such as apparatus for display, recording, offset printing, and engraving, and facsimile machines.

FIG. 1 illustrates schematically an example of the constitution of an electrophotographic apparatus employing an electrophotographic photosensitive member of the present invention.

In FIG. 1, an electrophotographic photosensitive member 1 of the present invention is driven to rotate around the axis 1*a* in the arrow direction at a prescribed peripheral speed. During rotation, the photosensitive member 1 is uniformly charged with positive or negative potential at the peripheral face by an electrostatic charging means 2, and then exposed to image-exposure L (e.g., slit exposure, laser beam-scanning exposure, etc.) at the exposure part 3 with an image-exposure means (not shown in the drawing), whereby an electrostatic latent image is successively formed on the peripheral surface in accordance with the image exposure.

The formed electrostatic latent image is developed with a toner by a developing means 4. The developed toner image is successively transferred by a transfer means 5 onto a surface of a transfer-receiving material P which is fed between the photosensitive member 1 and the transfer means 5 synchronously with the rotation of the photosensitive member 1 from a transfer-receiving material feeder not shown in the drawing.

The transfer-receiving material P which has received the transferred image is separated from the photosensitive member surface, and introduced to an image fixing means 8 for fixation of the image and sent out from the copying machine as a duplicate copy.

The surface of the photosensitive member 1, after the image transfer, is cleaned with a cleaning means 6 to remove any remaining non-transferred toner, and is treated for charge elimination with a pre-exposure means 7 for repeating image formation.

The generally employed charging means 2 for uniformly charging the photosensitive member 1 is a corona charging apparatus. The generally employed transfer means 5 is also a corona charging means. In the electrophotographic apparatus, two or more of the constitutional elements selected from the above-described photosensitive member 1, the developing means 4, the cleaning means 6, etc. may be integrated into one device unit, detachable from the main body of the apparatus. For example, at least one of the charging means 2, the developing means 4, and the cleaning means 6 is combined with the photosensitive member 1 into one device unit which is removable from the main body of the apparatus by aid of a guiding means such as a rail in the main body of the apparatus.

When the electrophotographic apparatus is used as a copying machine or a printer, the image exposure light L may be projected onto the photosensitive member as reflected light or transmitted light from an original copy, or otherwise the image information read out by a sensor from an original may be signalized, and according to the signals light is projected onto a photosensitive member, by scanning with a laser beam, driving an LED array, or driving a liquid crystal shutter array.

Figure 2:
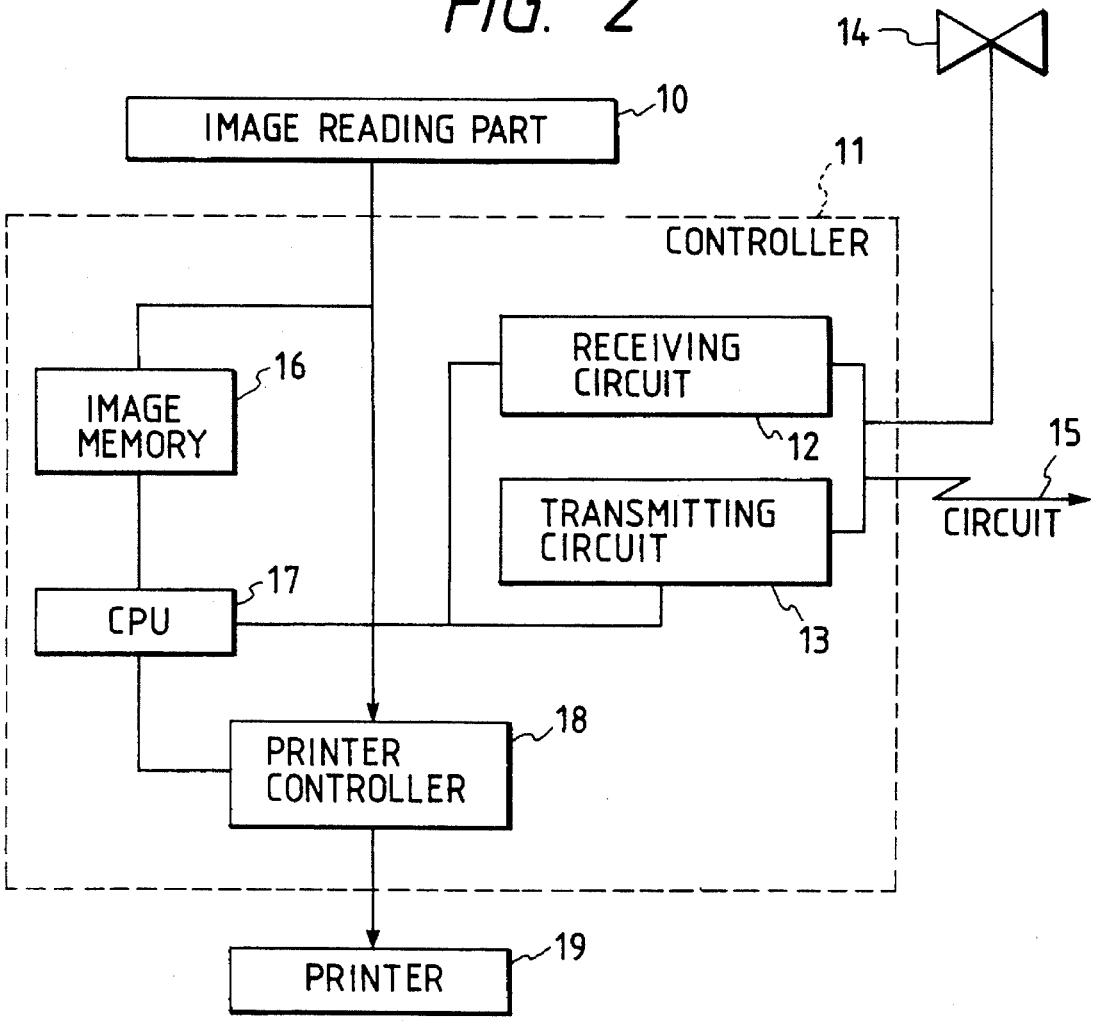
FIG. 2 shows an example of a block diagram of a facsimile system employing an electrophotographic photosensitive member of the present invention.

When the electrophotographic apparatus is used as a printer of a facsimile machine, the optical image exposure light L is employed for printing the received data. FIG. 2 is a block diagram of an example of this case.

A controller 11 controls the image-reading part 10 and a printer 19. The entire of the controller 11 is controlled by a CPU 17. Readout data from the image reading part 10 is transmitted through a transmitting circuit 13 to the other communication station. Data received from the other communication station is transmitted through a receiving circuit 12 to a printer 19. The image data is stored in an image memory 16. A printer controller 18 controls a printer 19. The numeral 14 denotes a telephone set.

The image received through a circuit 15, namely image information from a remote terminal connected through the circuit, is demodulated by the receiving circuit 12, treated for decoding of the image information in CPU 17, and successively stored in the image memory 16. When at least one page of image information has been stored in the image memory 16, the images are recorded in such a manner that the CPU 17 reads out one page of the image information, and sends out the one page of the decoded information to the printer controller 18, which controls the printer 19 on receiving the one page of the information from CPU 17 to record the image information.

During recording by the printer 19, the CPU 17 receives the subsequent page of information.

Images are received and recorded in the manner as described above.

The present invention is described in more detail by reference to examples. In Examples, "parts" is based on weight.

Example 1

On an aluminum cylinder of 80 mm in outside diameter, 1.5 mm in thickness, and 363 mm in length, a subbing layer was formed by applying a solution of 10 parts of nylon (M-4000, made by Toray Industries, Inc.) in a mixed solvent of 10 parts of methanol and 90 parts isopropanol by dip coating.

Separately, a coating liquid for a charge-generating layer was prepared by dispersing 10 parts of the trisazo pigment represented by the formula below in a solution of 5 parts of polycarbonate (bisphenol A type having a number-average molecular weight of 20,000) in 600 parts of cyclohexanone by means of a sand mill:

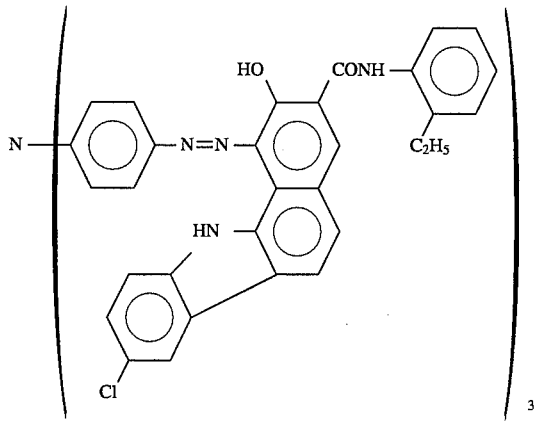

A charge-generating layer was formed in a thickness of 0.15 μm on the aforementioned subbing layer by applying this coating liquid by dip coating and drying liquid at 120° C. for 20 minutes.

A solution for a charge-transporting layer was prepared by dissolving 20 parts of the compound represented by the formula below, and 20 parts of polycarbonate (bisphenol Z type, having a number-average molecular weight of 16,000) in 800 parts of chlorobenzene by means of a ball mill:

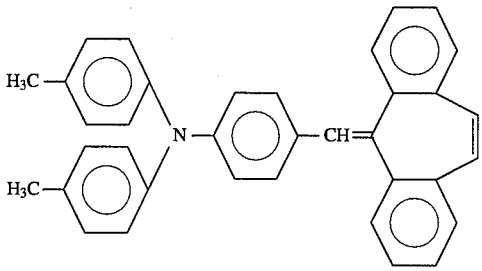

A charge-transporting layer was formed in a thickness of 18 μm on the above charge-generating layer by applying this solution by dip coating and drying at 130° C. for 90 minutes.

Then a coating liquid for a surface layer was prepared by dispersing 10 parts of particulate polytetrafluoroethylene (Lubron L-2, made by Daikin Industries, Ltd.) using a sandmill in a solution of 10 parts of polycarbonate (bisphenol Z type, having a number-average molecular weight of 85,000), and 5 parts of the compound represented by the formula below diluted in 450 parts of dichloromethane:

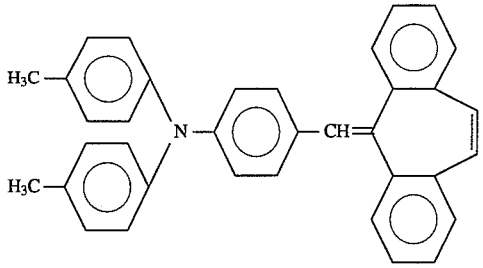

A surface layer of 2.0 μm was formed by dip coating of this solution on the above charge-transporting layer and drying at 120° C. for 30 minutes.

The resulting electrophotographic photosensitive member was mounted on a modified apparatus of a full-color copying machine (CLC-500, made by Canon Inc.), and 20,000 sheets of image formation was carried out to test the durability. The potential characteristics were evaluated by comparing the values of the dark-area potentials ($V_D$), the light-area potentials ($V_L$), and the residual potentials ($V_r$: potential after pre-exposure) at the start of and the end of the durability test. The dark-area potential and the light-area potential at the start of the test were adjusted to −700 V and −200 V respectively. The quality of the formed image was macroscopically evaluated.

The results are shown in Table 1.

Example 2–5, and Comparative Examples 1–3

Electrophotographic photosensitive members were prepared and evaluated in the same manner as in Example 1 except that the number-average molecular weights of the resins for the charge-transporting layer and for the surface layer were changed as shown in Table 1.

Comparative Example 4

An electrophotographic photosensitive member was prepared and evaluated in the same manner as in Example 1 except that the surface layer was not provided and the thickness of the charge-transporting layer was changed to 20 μm.

The results are shown in Table 1.

Example 6

An electrophotographic photosensitive member was prepared and evaluated in the same manner as in Example 1 except that the resins incorporated in the charge-transporting layer and the surface layer were changed to polymethyl acrylate of number average molecular weight of 25,000, and of number-average molecular weight of 100,000 respectively.

The results are shown in Table 2.

Example 7–10, and Comparative Examples 5–7

Electrophotographic photosensitive members were prepared and evaluated in the same manner as in Example 6 except that the number-average molecular weights of the resins for the charge-transporting layer and for the surface layer were changed as shown in Table 2.

The results are shown in Table 2.

Example 11

An electrophotographic photosensitive member was prepared and evaluated in the same manner as in Example 1 except that the resin contained in the charge-transporting layer was changed to the styrene-methyl methacrylate copolymer represented by the formula below and having a number-average molecular weight of 22,000:

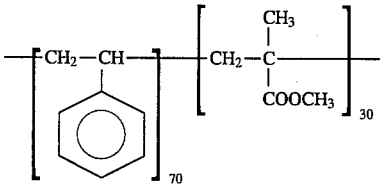

(where the numerals 70 and 30 denote the molar ratio), and the resin contained in the surface layer was changed to the styrene-methyl methacrylate copolymer represented by the formula below and having a number-average molecular weight of 60,000:

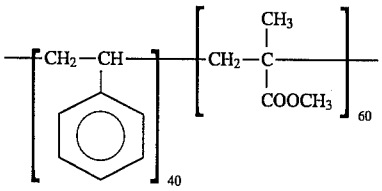

(where the numerals 40 and 60 denote the molar ratio).

The results are shown in Table 3.

Example 12–15, and Comparative Examples 8 and 9

Electrophotographic photosensitive members were prepared and evaluated in the same manner as in Example 11 except that the number-average molecular weights of the resins for the charge-transporting layer and for the surface layer were changed as shown in Table 3.

Comparative Example 10

An electrophotographic photosensitive member was prepared and evaluated in the same manner as in Example 11 except that the particles of polytetrafluoroethylene were not used.

The results are shown in Table 3.

TABLE 1

| | Molecular weight of resin in surface layer ($Mn_1$) | Molecular weight of resin in photosensitive layer ($Mn_2$) | $Mn_1/Mn_2$ | Start of durability test (–V) $V_D$ | $V_L$ | $V_r$ | End of durability test (–V) $V_D$ | $V_L$ | $V_r$ | Image evaluation |
|---|---|---|---|---|---|---|---|---|---|---|
| Example | | | | | | | | | | |
| 1 | 85,000 | 16,000 | 5.3 | 700 | 200 | 30 | 690 | 190 | 35 | Excellent quality to 20,000th sheet |
| 2 | 80,000 | 20,000 | 4.0 | 700 | 200 | 40 | 690 | 190 | 30 | Excellent quality to 20,000th sheet |
| 3 | 60,000 | 16,000 | 3.8 | 700 | 200 | 40 | 680 | 170 | 40 | Excellent quality to 20,000th sheet |
| 4 | 50,000 | 20,000 | 2.5 | 700 | 200 | 35 | 680 | 170 | 40 | Excellent quality to 20,000th sheet |
| 5 | 100,000 | 50,000 | 2.0 | 700 | 200 | 30 | 700 | 195 | 35 | Excellent quality to 20,000th sheet |
| Comparative Example | | | | | | | | | | |
| 1 | 20,000 | 16,000 | 1.3 | 700 | 200 | 110 | 600 | 330 | 180 | Low image density at 3,000th sheet, nonuniform half-tone at 7,500th sheet, black stripes in image at 9,000th sheet |
| 2 | 40,000 | 16,000 | 2.5 | 700 | 200 | 45 | 630 | 220 | 100 | Nonuniform half-tone at 13,000th sheet, black stripes in image at 15,000th sheet |
| 3 | 120,000 | 60,000 | 2.0 | Charge-transporting layer not uniformly formed, irregular charging from start, potential being irregular and not measured | | | | | | Image density non-uniform from initial stage |
| 4 | — | 16,000 | — | 700 | 200 | 35 | 570 | 350 | 200 | Black stripes in image at 7,000th sheet, low image density at 10,000th sheet |

TABLE 2

| | Molecular weight of resin in surface layer ($Mn_1$) | Molecular weight of resin in photosensitive layer ($Mn_2$) | $Mn_1/Mn_2$ | Start of durability test (−V) $V_D$ | $V_L$ | $V_r$ | End of durability test (−V) $V_D$ | $V_L$ | $V_r$ | Image evaluation |
|---|---|---|---|---|---|---|---|---|---|---|
| Example | | | | | | | | | | |
| 6 | 100,000 | 25,000 | 4.0 | 700 | 200 | 35 | 695 | 190 | 35 | Excellent quality to 20,000th sheet |
| 7 | 70,000 | 25,000 | 2.8 | 700 | 200 | 30 | 690 | 180 | 40 | Excellent quality to 20,000th sheet |
| 8 | 50,000 | 25,000 | 2.0 | 700 | 200 | 30 | 690 | 180 | 45 | Excellent quality to 20,000th sheet |
| 9 | 160,000 | 30,000 | 5.3 | 700 | 200 | 40 | 700 | 195 | 40 | Excellent quality to 20,000th sheet |
| 10 | 120,000 | 20,000 | 6.0 | 700 | 200 | 40 | 695 | 190 | 35 | Excellent quality to 20,000th sheet |
| Comparative Example | | | | | | | | | | |
| 5 | 15,000 | 25,000 | 0.6 | 700 | 200 | 80 | 630 | 300 | 190 | Low image density at 3,000th sheet, nonuniform half-tone at 7,000th sheet, black stripes in image at 11,000th sheet |
| 6 | 70,000 | 40,000 | 1.8 | 700 | 200 | 100 | 750 | 340 | 220 | Low image density at 4,000the sheet |
| 7 | 180,000 | 35,000 | 5.1 | 700 | 200 | 40 | 630 | 270 | 130 | Black stripes in image at 9,000th sheet, nonuniform half-tone at 14,000th sheet |

TABLE 3

| | Molecular weight of resin in surface layer ($Mn_1$) | Molecular weight of resin in photosensitive layer ($Mn_2$) | $Mn_1/Mn_2$ | Start of durability test (−V) $V_D$ | $V_L$ | $V_r$ | End of durability test (−V) $V_D$ | $V_L$ | $V_r$ | Image evaluation |
|---|---|---|---|---|---|---|---|---|---|---|
| Example | | | | | | | | | | |
| 11 | 60,000 | 22,000 | 2.7 | 700 | 200 | 40 | 680 | 190 | 45 | Excellent quality to 20,000th sheet |
| 12 | 80,000 | 22,000 | 3.6 | 700 | 200 | 30 | 685 | 190 | 50 | Excellent quality to 20,000th sheet |
| 13 | 60,000 | 10,000 | 6.0 | 700 | 200 | 30 | 680 | 195 | 35 | Excellent quality to 20,000th sheet |
| 14 | 60,000 | 15,000 | 4.0 | 700 | 200 | 40 | 680 | 185 | 30 | Excellent quality to 20,000th sheet |
| 15 | 140,000 | 40,000 | 3.5 | 700 | 200 | 35 | 695 | 200 | 35 | Excellent quality to 20,000th sheet |
| Comparative Example | | | | | | | | | | |
| 8 | 50,000 | 8,000 | 6.3 | Charge-transporting layer not uniformly formed, irregular charging from initial stage, potential being irregular and not measured | | | | | | Image density non-uniform from initial stage |
| 9 | 80,000 | 50,000 | 1.6 | 700 | 200 | 90 | 800 | 360 | 220 | Low image density at 3,000th sheet |
| 10 | 60,000 | 15,000 | 4.0 | 700 | 200 | 30 | — | — | — | Cleaning blade reversed at 5,000th sheet and test stopped |

What is claimed is:

1. An electrophotographic photosensitive member comprising:

a photosensitive layer formed on an electroconductive support, and a surface layer formed on the photosensitive layer;

said photosensitive layer containing a charge-generating substance, a charge-transporting substance, and a binder resin, and said surface layer containing fluorine-atom-containing resin particles, a charge-transporting substance and a binder resin;

the binder resin in the surface layer and the binder resin in the photosensitive layer having the same constitution component(s), the binder resin in the surface layer having a number-average molecular weight of from 50,000 to 160,000 and the binder resin in the photosensitive layer having a number-average molecular weight of from 10,000 to 50,000 and the number-average molecular weight of the binder resin in the surface layer being two or more times larger than that of the binder resin in the photosensitive layer, the photosensitive layer having a thickness of from 10 to 35 μm, and the surface layer having a thickness of from 0.05 to 10 μm.

2. An electrophotographic photosensitive member according to claim 1, wherein the binder resin in the surface layer has a number-average molecular weight of from 60,000 to 100,000.

3. An electrophotographic photosensitive member according to claim 1, wherein the binder resin in the photosensitive layer has a number-average molecular weight of from 15,000 to 40,000.

4. An electrophotographic photosensitive member according to claim 1, wherein the binder resin in the surface layer has a number-average molecular weight of from 60,000 to 100,000, and the binder resin in the photosensitive layer has a number-average molecular weight of from 15,000 to 40,000.

5. An electrophotographic photosensitive member according to claim 1, wherein the binder resin in the surface layer has a number-average molecular weight not larger than six times of that of the binder resin in the photosensitive layer.

6. An electrophotographic photosensitive member according to claim 1, wherein the binder resin in the surface layer has a number-average molecular weight of from 60,000 to 100,000, the binder resin in the photosensitive layer has a number-average molecular weight of from 15,000 to 40,000, and the binder resin in the surface layer has a number-average molecular weight not larger than six times of that of the binder resin in the photosensitive layer.

7. An electrophotographic photosensitive member according to claim 1, wherein the photosensitive layer has a thickness of from 15 to 30 μm.

8. An electrophotographic photosensitive member according to claim 1, wherein the photosensitive layer is of a lamination type, having a charge-generation layer and a charge-transporting layer.

9. An electrophotographic photosensitive member according to claim 8, wherein the electrophotographic photosensitive member has a charge-generating layer formed on an electroconductive support, a charge-transporting layer formed on the charge-generating layer, and a surface layer formed on the charge-transporting layer.

10. An electrophotographic photosensitive member according to claim 9, wherein the charge-transporting layer has a thickness of from 10 to 35 μm.

11. An electrophotographic photosensitive member according to claim 10, wherein the charge-transporting layer has a thickness of from 15 to 30 μm.

12. An electrophotographic photosensitive member according to claim 1, wherein the photosensitive layer is of a single layer type.

13. An electrophotographic photosensitive member according to claim 12, wherein the photosensitive layer has a thickness of from 10 to 35 μm.

14. An electrophotographic photosensitive member according to claim 13, wherein the photosensitive layer has a thickness of from 15 to 30 μm.

15. An electrophotographic photosensitive member according to claim 1, wherein the electrophotographic photosensitive member has a subbing layer between the electroconductive support and the photosensitive layer.

16. An electrophotographic apparatus, comprising:

an electrophotographic photosensitive member, an image-forming means for forming an electrostatic latent image, a developing means for developing the formed latent image, and a transferring means for transferring the developed image to an image-receiving material;

said electrophotographic photosensitive member comprising a photosensitive layer formed on an electroconductive support and a surface layer formed on the photosensitive layer;

the photosensitive layer containing a charge-generating substance, a charge-transporting substance, and a binder resin, and the surface layer containing fluorine-atom-containing resin particles, a charge transporting substance, and a binder resin;

the binder resin in the surface layer and the binder resin in the photosensitive layer having the same constitution component(s), the binder resin in the surface layer having a number-average molecular weight of from 50,000 to 160,000 and the binder resin in the photosensitive layer having a number-average molecular weight of from 10,000 to 50,000, and the number-average molecular weight of the binder resin in the surface layer being two or more times larger than that of the binder resin in the photosensitive layer, the photosensitive layer having a thickness of from 10 to 35 μm, and the surface layer having a thickness of from 0.05 to 10 μm.

17. A device unit, comprising an electrophotographic photosensitive member, and at least one means selected from the group consisting of a charging means, a developing means, and a cleaning means;

said electrophotographic photosensitive member comprising a photosensitive layer formed on an electroconductive support, and a surface layer formed on the photosensitive layer;

the photosensitive layer containing a charge-generating substance, a charge-transporting substance, and a binder resin, and the surface layer containing fluorine-atom-containing resin particles, a charge transporting substance, and a binder resin;

the binder resin in the surface layer and the binder resin in the photosensitive layer having the same constitution components, the binder resin in the surface layer having a number-average molecular weight of from 50,000 to 160,000 and the binder resin in the photosensitive layer having a number-average molecular weight of from 10,000 to 50,000, and the number-average molecular weight of the binder resin in the surface layer is two or more times larger than that of the binder resin in the photosensitive layer, the photosensitive layer having a thickness of from 10 to 35 μm, the surface layer having a thickness of from 0.05 to 10 μm, and said unit integrally holding the electrophotographic photosensitive member and at least one of the charging means, the developing means, and the cleaning means, and being removable from a main body of the electrophotographic apparatus.

18. An electrophotographic photosensitive member comprising:

a photosensitive layer formed on an electroconductive support, and a surface layer formed on the photosensitive layer;

said photosensitive layer containing a charge-generating substance, a charge-transporting substance, and a binder resin, and said surface layer containing fluorine-atom-containing resin particles and a binder resin;

the binder resin in the surface layer and the binder resin in the photosensitive layer having the same constitution component(s), the binder resin in the surface layer having a number-average molecular weight of from 50,000 to 160,000 and the binder resin in the photosensitive layer having a number-average molecular weight of from 10,000 to 50,000 and the number-average molecular weight of the binder resin in the surface layer being two or more times larger than that of the binder resin in the photosensitive layer, the photosensitive layer having a thickness of from 10 to 35 μm, and the surface layer having a thickness of from 0.05 to 10 μm.

* * * * *

UNITED STATES PATENT AND TRADEMARK OFFICE

CERTIFICATE OF CORRECTION

PATENT NO. : 5,504,558

DATED : April 2, 1996

INVENTOR(S) : Tatsuya Ikezue

It is certified that error appears in the above-identified patent and that said Letters Patent is hereby corrected as shown below:

COLUMN 1

Line 37, "a" should be deleted.

COLUMN 3

Line 1, "compatible each" should read --compatible with each--.

COLUMN 4

Line 39, "tatrafluoroethylene-" should read --tetrafluoroethylene- --.

Line 47, "luburicity" should read --lubricity--.

COLUMN 5

Line 44, "reins, nylons,," should read --resins, nylon,--.

UNITED STATES PATENT AND TRADEMARK OFFICE

CERTIFICATE OF CORRECTION

PATENT NO. : 5,504,558

DATED : April 2, 1996

INVENTOR(S) : Tatsuya Ikezue

It is certified that error appears in the above-identified patent and that said Letters Patent is hereby corrected as shown below:

COLUMN 12

Table 2, "4,000the" should read --4,000th--.

Signed and Sealed this

Twenty-seventh Day of August, 1996

*Attest:*

*Attesting Officer*

Bruce Lehman

BRUCE LEHMAN

*Commissioner of Patents and Trademarks*